United States Patent [19]

Dix

[11] Patent Number: 4,844,941

[45] Date of Patent: Jul. 4, 1989

[54] METHOD OF MONITORING PRODUCTION OF PROTECTIVE FABRIC

[75] Inventor: James K. Dix, Ottawa, Canada

[73] Assignee: Her Majesty the Queen in right of Canada, as represented by the Minister of National Defence of Her Majesty's Canadian Government, Ottawa, Canada

[21] Appl. No.: 225,799

[22] Filed: Jul. 29, 1988

[51] Int. Cl.[4] ..... B05D 3/06

[52] U.S. Cl. ..... 427/8; 427/128

[58] Field of Search ..... 427/8, 48, 128, 132

*Primary Examiner*—Bernard Pianalto

*Attorney, Agent, or Firm*—Nixon & Vanderhye

[57] ABSTRACT

The quantity of chemical, e.g. charcoal added to fabric used to produce protective clothing for the military is usually determined by the simple expedient of weighing the fabric or swatches thereof before and after impregnation in a charcoal slurry. This method may result in large errors. A simple, effective method of determining the quantity of charcoal or other chemical being incorporated in a fabric base is to add a magnetic tracer, e.g. magnetite to the chemical prior to impregnation, and to measure the magnetic susceptibility of the fabric on a continuous basis immediately following impregnation. If the magnetic tracer is uniformly mixed with the chemical, the direct correlation between magnetic susceptibility and tracer concentration will provide an accurate indication of tracer and consequently chemical concentration in the fabric.

7 Claims, No Drawings

METHOD OF MONITORING PRODUCTION OF PROTECTIVE FABRIC

BACKGROUND OF THE INVENTION

1. Field of the Invention

This invention relates to a method of monitoring the production of clothing fabric, and in particular to a method of monitoring the production of fabric for use in protective clothing.

2. Discussion of the Prior Art

When producing protective clothing for the military, a variety of chemicals, e.g. charcoal, latex and flame retardant are applied to the clothing fabric. Typically, application is effected by dipping the fabric in solutions or slurries of the chemicals, and passing the fabric between squeeze rolls to control the quantity of chemical added to the fabric. In the present case, the aim is to control the quantity of charcoal added to the clothing material. The quantity of charcoal incorporated in the fabric must be monitored and controlled in order to ensure that the clothing provides adequate protection.

At present, the quantity of charcoal added to fabric is controlled by two methods, either or both of which may be used at one time. The first method involves the weighing of one hundred meter rolls of material before and after passage through a charcoal bath and squeeze rolls. A figure representing the average concentration of charcoal in the entire roll is obtained from the equation:

$$\frac{\text{wt after impregnation} - \text{wt before impregnation}}{\text{wt before impregnation}} \times 100 = \%\text{ of added material}$$

The second method involves the cutting of small pieces of material from the untreated material, and then passing the material through the charcoal bath and between the squeeze rolls. Additional small pieces are cut from the fabric adjacent to the first "cuts" and of identical size. The quantity of charcoal added to the material is calculated using the above equation.

The above described measuring methods are not without shortcomings. The first method relies on a number of assumptions. Firstly, it must be assumed that the starting material, i.e. the fabric to be impregnated is uniform in terms of weight per unit area. It has been found that the foam laminate presently used in protective military clothing may vary in weight from batch to batch. Thus, if the weight of the untreated material is considered to be a constant, then errors in the calculation of the quantity of added charcoal will occur. Other factors can affect the quantity of chemical added to the fabric during each impregnation operation. It has also been found that if all parameters are kept constant, the quantity of added material can increase constantly through an impregnation operation. Thus, even though the average value obtained using the first method is indicative of acceptable material, there could be large areas of fabric which are unacceptable in terms of charcoal content. Such areas would be detected during the more detailed testing of quality control. However, the problem cannot be corrected after the material has been dried and cured.

For the most part, the above comments are equally applicable to the second method. Taking small samples or templates as representative of an entire roll of material could be extremely misleading, because of the cyclic nature of the adding of the chemical under constant processing conditions and the inherent variations in the base material. The second method also requires destructive sampling of the base material.

The object of the present invention is to overcome the problems encountered using present measuring techniques by providing a relatively simple, accurate method of determining the quantity of chemical being added to a fabric on a continuous basis.

GENERAL DESCRIPTION OF THE INVENTION

Accordingly, the present invention relates to a method of monitoring the production of protective clothing fabric of the type including a chemical incorporated therein by impregnation comprising the steps of:

(a) uniformly mixing a magnetic tracer with an impregnation liquid containing said chemical; and (b) monitoring the magnetic susceptibility of the impregnated fabric to determine the quantity of magnetic tracer and consequently the quantity of chemical added to the fabric.

DESCRIPTION OF THE PREFERRED EMBODIMENTS

In a specific application of the method of the present invention, commercially available magnetic susceptibility measuring instruments are used to monitor the quantity of charcoal being added to protective fabric. The use of a sensor head proximate the path of travel of the material enables continuous, non-destructive monitoring of the material. One suitable instrument for this purpose is susceptibility meter available from Sapphire Instruments of Windsor, Ontario. Another, slightly more sensitive instrument used experimentally, but no longer commercially available is the VGF KL-1 magnetic susceptibility bridge.

In order to test the method, a magnetic tracer, which in this case was magnetite ($Fe_3O_4$) was uniformly mixed with a regular charcoal slurry in a variety of quantities based on the quantities of charcoal in the slurry. This experiment was intended to determine an acceptable tracer level. Loadings ranged from 0.04 to 20 g/m$^2$ of magnetite on the base fabric. An extremely linear relationship exists between the loading of magnetite and the magnetic susceptibility through in excess of three orders of magnitude.

In addition to the above mentioned experiment, values for three different magnetic susceptibility instruments were obtained to determine the range of tracer loading required to effect reasonable monitoring of charcoal addition. For a JH-8 susceptibility meter, approximately 3–20%, preferably 6% magnetite on a solds basis (1.8–11.8, preferably 3.5 parts magnetite per 100 parts by weight charcoal) were required. The Sapphire Instruments device requires cut samples. However, if a sensor head is used, continuous monitoring can be effected. The quantity of tracer required for the Sapphire Instruments equipment was 0.5 to 10%, preferably 1% magnetite on a solids basis (0.3–5.9, preferably 0.6 parts per 100 parts by weight charcoal). The VGF KL-1 magnetic susceptibility bridge also requires cut samples in the absence of a sensor head, and a magnetic tracer in the amount of 0.5 to 10%, preferably 1.7% on a solids basis (0.3 - 5.9, preferably 1 part per 100 parts by weight charcoal).

It will be appreciated that a determination of the correlation between the magnetic susceptibility and the quantity of charcoal or other material being added should be easy to establish. Thus, a direct reading of the quantity of solids being added to the base fabric can be obtained from the magnetic susceptibility instrument. With the continuous monitoring of the quantity of charcoal (or other chemical) being added to the base fabric, the squeeze roll pressure and other parameters can be varied to ensure that the charcoal concentration in the finished product is more or less constant over the entire length thereof.

Due care must be taken during mixing and impregantion of material that no metals capable of attracting the magnetite are used. It is also worth noting that the particle size of the magnetite may have an effect on the magnetic susceptibility of the material.

Another experiment performed using magnetic susceptibility instruments is the measurement of the magnetic susceptibility of a plurality of charcoal impregnated foam samples over a wide range of charcoal concentrations in the absence of magnetite tracer. The tests showed a correlation between the quantity of added charcoal and magnetic susceptibility. However, the magnetic response was weaker than for samples containing magnetite tracer. Unimpregnated material had no measurable magnetic susceptibility. It appears that the charcoal used has an inherent magnetic susceptibility which raises the question of whether the tracer is absolutely necessary. Of course, in the absence of a magnetic tracer, the chemical being added to the base fabric must have an inherent magnetic susceptibility.

While magnetite is the specific magnetic tracer used in the above examples, it will be appreciated that other minerals such as titanomagnetite, ilmenite and pyrrhotite can be used as the magnetic tracer. A tracer such as $HgCo(NCS)_4$, which is a highly paramagnetic complex, could also be used, permitting the use of lower quantities of tracer in the impregnating slurries or solutions.

Thus, there has been described a relatively simple method of monitoring and assisting in the control of the finishing of a fabric, i.e. the addition of a chemical to the fabric to alter the properties thereof.

I claim:

1. A method of monitoring the production of protective clothing fabric of the type including a chemical incorporated therein by impregnation, comprising the steps of:

(a) uniformly mixing a magnetic tracer with an impregnation liquid containing said chemical; and (b) monitoring the magnetic susceptibility of the impregnated fabric to determine the quantity of magnetic tracer and consequently the quantity of chemical added to the fabric.

2. A method according to claim 1, wherein said chemical is charcoal to be added to the fabric as a barrier material.

3. A method according to claim 1, wherein said magnetic tracer is selected from the group consisting of magnetite, titanomagnetite, ilmenite and pyrrhotite.

4. A method of controlling the production of a clothing fabric of the type including charcoal as a barrier material comprising the steps of:

(a) uniformly mixing a magnetic tracer with a charcoal slurry; and (b) monitoring the magnetic susceptibility of the fabric impregnated with the slurry to determine the quantity of magnetic tracer and consequently the quantity of charcoal added to the fabric.

5. A method according to claim 4, wherein said magnetic tracer is magnetite.

6. A method of monitoring the production of protective clothing fabric of the type including a chemical having a magnetic susceptibility incorporated therein by impregnation, comprising the step of monitoring the magnetic susceptibility of the impregnated fabric to determine the quantity of chemical added to the fabric.

7. A method according to claim 6, wherein the chemical is charcoal.

* * * * *